US010570586B2

(12) United States Patent
Zell

(10) Patent No.: US 10,570,586 B2
(45) Date of Patent: Feb. 25, 2020

(54) HYDRAULIC CONTROL CIRCUIT FOR AN ARTICULATION ASSEMBLY

(71) Applicant: Deere & Company, Moline, IL (US)

(72) Inventor: Adam Zell, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 15/942,685

(22) Filed: Apr. 2, 2018

(65) Prior Publication Data

US 2019/0301139 A1 Oct. 3, 2019

(51) Int. Cl.

| | |
|---|---|
| ***E02F 9/22*** | (2006.01) |
| ***F15B 11/16*** | (2006.01) |
| ***E02F 9/08*** | (2006.01) |
| *E02F 3/76* | (2006.01) |

(52) U.S. Cl.

CPC ..... *E02F 9/225* (2013.01); *E02F 9/0841* (2013.01); *F15B 11/16* (2013.01); *E02F 3/7636* (2013.01); *F15B 2211/35* (2013.01); *F15B 2211/6306* (2013.01); *F15B 2211/6346* (2013.01); *F15B 2211/7053* (2013.01); *F15B 2211/7107* (2013.01)

(58) Field of Classification Search

CPC ..... E02F 9/0841; E02F 9/225; F15B 11/16; F15B 11/20; F15B 13/022; F15B 13/06

See application file for complete search history.

(56) References Cited

U.S. PATENT DOCUMENTS

| | | | | |
|---|---|---|---|---|
| 6,152,237 | A | 11/2000 | Hartman et al. | |
| 7,610,989 | B2 * | 11/2009 | Vigholm | F15B 20/008 180/418 |
| 8,087,489 | B2 * | 1/2012 | Tanaka | E02F 9/225 180/418 |
| 9,085,319 | B2 * | 7/2015 | Innanishi | E02F 9/0841 |
| 9,340,954 | B2 | 5/2016 | Anderson | |
| 9,771,705 | B2 | 9/2017 | Horstman | |
| 10,253,477 | B2 * | 4/2019 | Kato | E02F 9/0841 |
| 10,266,200 | B2 * | 4/2019 | Takenaka | E02F 9/0841 |

* cited by examiner

*Primary Examiner* — Michael Leslie

(74) *Attorney, Agent, or Firm* — Michael Best & Friedrich LLP

(57) ABSTRACT

A work vehicle includes a first frame, a second frame pivotally coupled to the first frame at an articulation joint, and a control circuit operable to control relative movement of the first and second frames about the articulation joint. The control circuit includes a pump, an actuator in fluid communication with the pump, and a first valve assembly coupled to a user-manipulable control. The first valve assembly is configured to direct fluid from the pump to the actuator in response to movement of the user-manipulable control to pivot the first and second frames. The control circuit also includes a second valve assembly configured to direct fluid from the pump to the actuator in response to receiving an electronic control signal to pivot the first and second frames.

19 Claims, 3 Drawing Sheets

HYDRAULIC CONTROL CIRCUIT FOR AN ARTICULATION ASSEMBLY

BACKGROUND

The present disclosure relates to hydraulic control circuits, and more particularly to a hydraulic control circuit for an articulation assembly of a work vehicle.

Many work vehicles include front and rear frames coupled together by an articulation joint to reduce the vehicle's turning radius and thereby improve maneuverability. An articulation joint may be passive or may be part of an active articulation assembly. An active articulation assembly typically includes one or more actuators to control a degree of articulation between the front and rear frames. The actuator(s) may be manually controlled. Under manual control, the actuator(s) cause the front frame to rotate relative to the rear frame in response to a steering input (e.g., provided via user-manipulation of a steering control). However, under manual control, it may be difficult to precisely maintain a desired degree of articulation. For example, it may be difficult to keep the work vehicle traveling in a straight line if even a small degree of articulation is present.

SUMMARY

The disclosure provides, in one aspect, a work vehicle including a first frame, a second frame pivotally coupled to the first frame at an articulation joint, and a control circuit operable to control relative movement of the first and second frames about the articulation joint. The control circuit includes a pump, an actuator in fluid communication with the pump, and a first valve assembly coupled to a user-manipulable control. The first valve assembly is configured to direct fluid from the pump to the actuator in response to movement of the user-manipulable control to pivot the first and second frames. The control circuit also includes a second valve assembly configured to direct fluid from the pump to the actuator in response to receiving an electronic control signal to pivot the first and second frames.

The disclosure provides, in another aspect, a work vehicle including a first frame, a second frame pivotally coupled to the first frame at an articulation joint, and a control circuit operable to control relative movement of the first and second frames about the articulation joint. The control circuit includes a pump, an actuator operable to pivot the first and second frames about the articulation joint in response to receiving fluid from the pump, a first valve assembly configured to direct fluid from the pump to the actuator, a second valve assembly configured to direct fluid from the pump to the actuator, and a third valve assembly positioned fluidly between the first and second valve assemblies and the actuator. The third valve assembly is configurable in a first state in which the third valve assembly fluidly communicates the first valve assembly with the actuator such that the first valve assembly controls movement of the actuator, and a second state in which the third valve assembly fluidly communicates the second valve assembly with the actuator such that the second valve assembly controls movement of the actuator.

The disclosure provides, in another aspect, a method of operating a work vehicle having first and second frame members pivotally coupled at an articulation joint and an actuator operable to pivot the first and second frames about the articulation joint in response to receiving fluid from a pump. The method includes moving a user-manipulable control to direct fluid from the pump to the actuator via a first valve assembly to pivot the first and second frame members from a non-articulated position to an articulated position. The method also includes commanding a controller to return the first and second frame members to the non-articulated position, and directing fluid from the pump to the actuator via a second valve assembly to pivot the first and second frame members toward the non-articulated position.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

Figure 1:
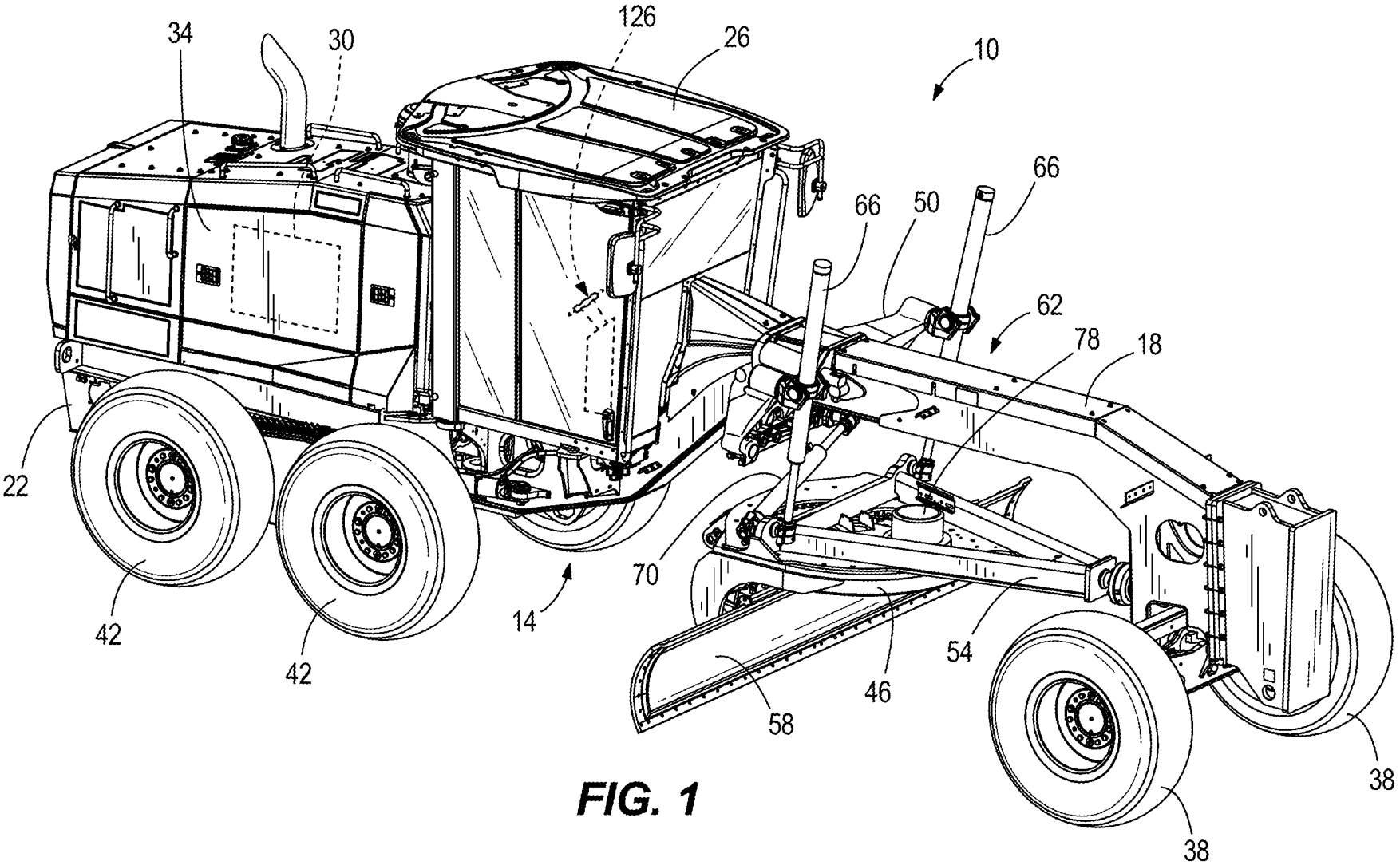
FIG. 1 is a perspective view of a work vehicle in which the disclosed hydraulic articulation system may be implemented.

FIG. 1 illustrates a work vehicle, which is a motor grader (or simply "grader") 10 in the illustrated embodiment. The grader 10 includes a chassis 14 with a front frame 18 and a rear frame 22. The front frame 18 supports an operator cab 26 that may include an operator seat, controls for operating the grader 10, and the like. A prime mover 30 (e.g., a diesel engine) is supported on the rear frame 22 and is enclosed within a compartment 34. The chassis 14 is supported by front wheels 38 at the front of the grader 10 and by tandem rear wheels 42 at the rear of the grader 10.

The grader 10 includes a circle 46 disposed in front of the operator cab 26 and suspended below the front frame 18 by a lifter bracket 50 and a drawbar 54. A work implement, which is a blade 58 or moldboard in the illustrated embodiment, extends laterally across the circle 46. The grader 10 includes a blade positioning assembly 62 that allows the position and orientation of the blade 58 to be adjusted. In the illustrated embodiment, lift actuators 66 extend between the lifter bracket 50 and the circle 46 to tilt, raise, and lower the circle 46 and the blade 58. A shift actuator 70 is provided to shift the blade 58 laterally relative to the front frame 18, and a pitch actuator 74 (FIG. 2) is provided to vary a pitch angle of the blade 58. The blade positioning assembly 62 also includes a rotary actuator 78 to rotate the blade 58 about a vertical axis. In the illustrated embodiment, the various actuators 66, 70, 74, 78 of the blade positioning assembly 62 are hydraulic actuators (e.g., single or double acting cylinders, hydraulic motors, etc.); however, the blade positioning assembly 62 may alternatively include one or more electric motors, pneumatic actuators, or the like in place of any of the hydraulic actuators 66, 70, 74, 78.

Figure 2:
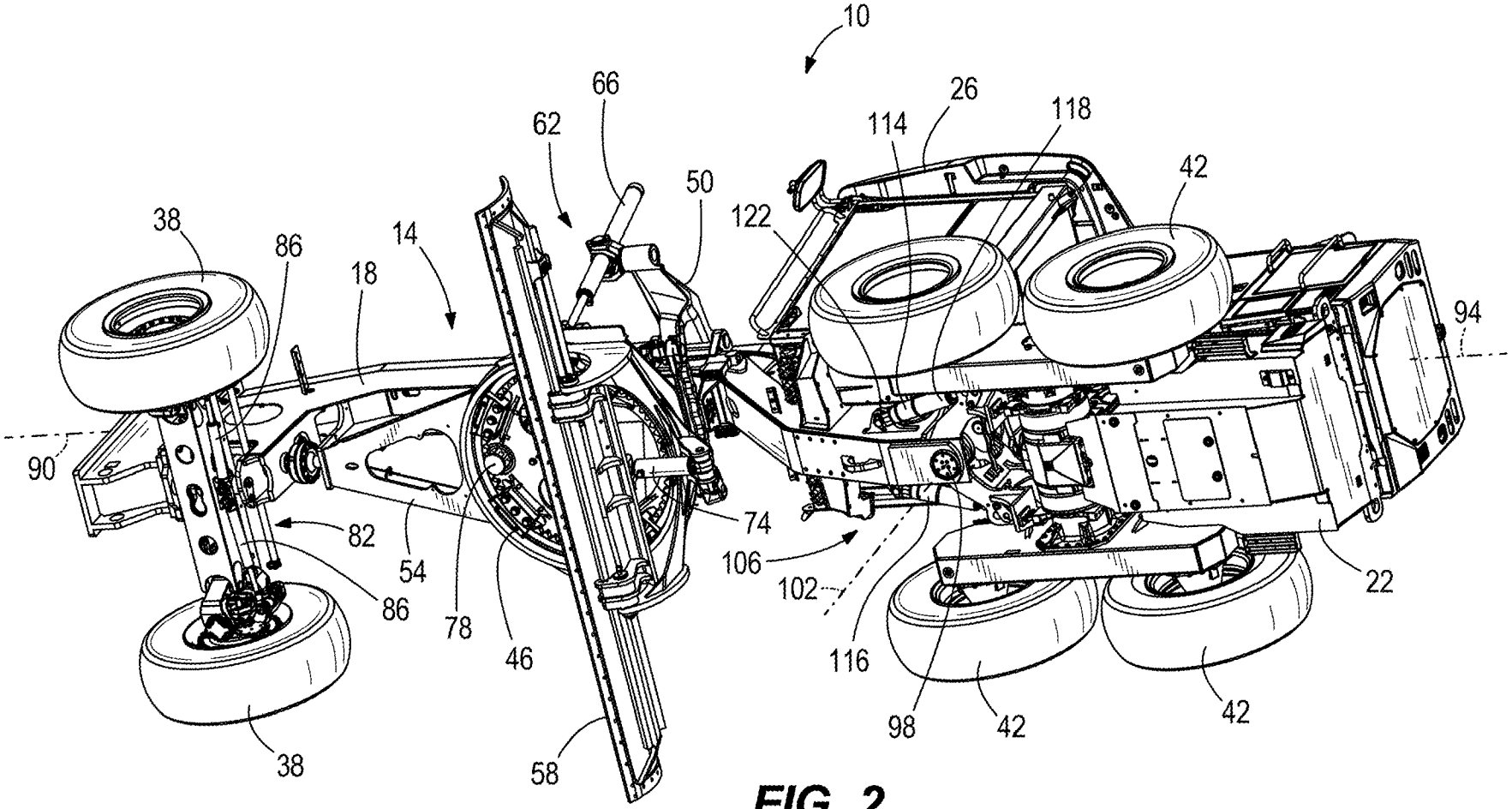
FIG. 2 is another perspective view of the work vehicle of FIG. 1.

The prime mover 30 is coupled to the rear wheels 42 via a suitable transmission (not shown) to drive the rear wheels 42 (FIG. 1). Alternatively or additionally, the prime mover 30 may be coupled to the front wheels 38 to drive the front wheels 38. The front frame 18 supports a steering assembly 82 for steering the front wheels 38 (FIG. 2). The steering assembly 82 includes steering actuators 86, which are hydraulic actuators in the illustrated embodiment. In other embodiments, other types of actuators can be used. In addition, in some embodiments, additional steering actuators may be provided such that both the front wheels 38 and the rear wheels 42 may be steerable.

The front frame 18 of the grader 10 defines a first or front longitudinal axis 90, and the rear frame 22 of the grader 10 defines a second or rear longitudinal axis 94. An articulation joint 98 pivotally couples the front frame 18 and the rear frame 22 and defines a vertical pivot or articulation axis 102 (FIG. 2). The front frame 18 is pivotable relative to the rear frame 22 about the articulation axis 102 to vary an orientation of the front longitudinal axis 90 relative to the rear longitudinal axis 94. The illustrated articulation joint 98 is part of an active articulation assembly 106 that includes first and second articulation actuators 114, 116 extending between the front frame 18 and the rear frame 22 on opposite lateral sides of the articulation axis 102. Each of the illustrated articulation actuators 114, 116 is a double-acting hydraulic cylinder having a rod 118 pivotally coupled to the rear frame 22 and a head 122 pivotally coupled to the front frame 18. In other embodiments, the number and/or arrangement of articulation actuators 114, 116 may vary.

Figure 3:
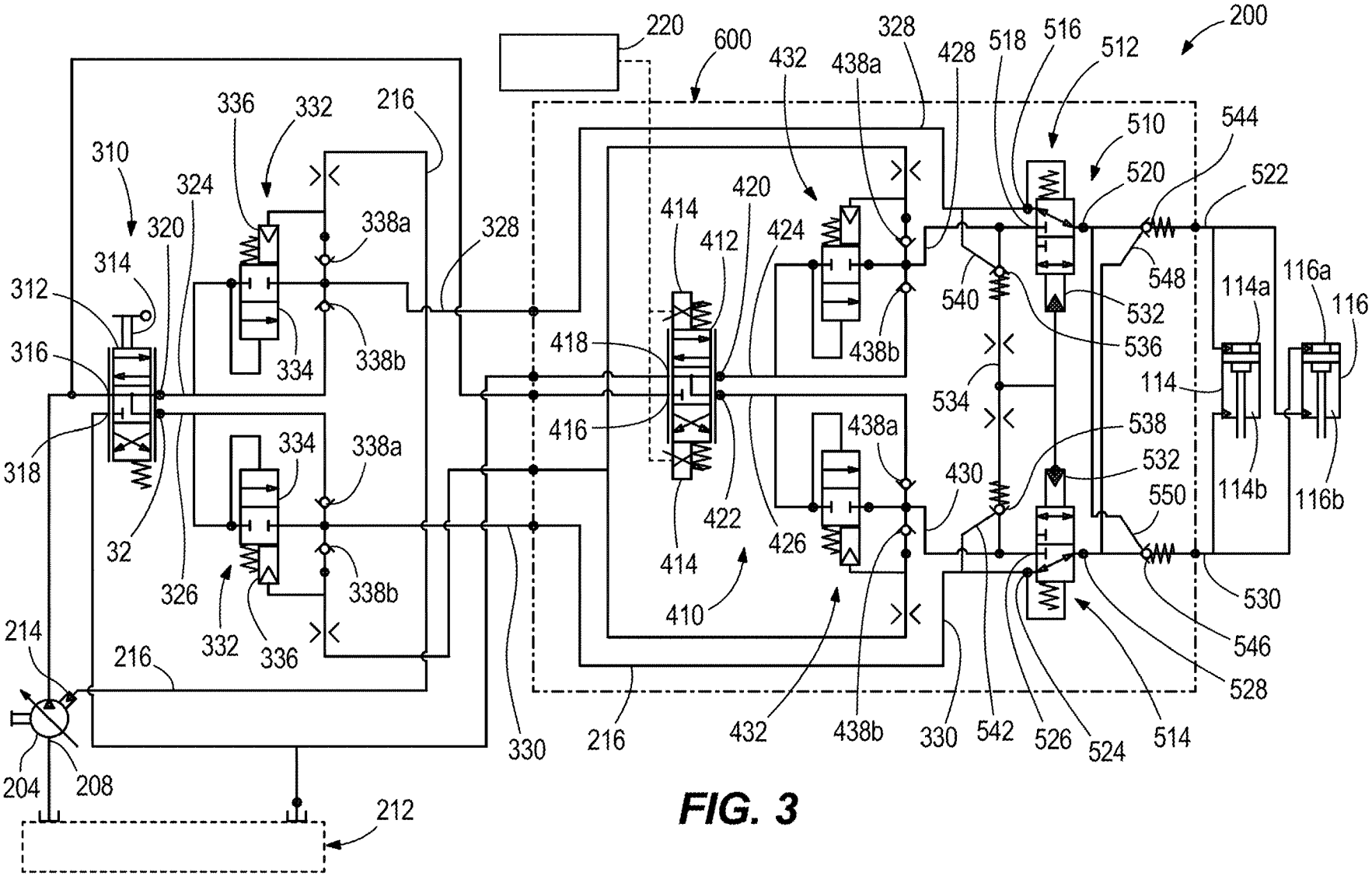
FIG. 3 is a schematic diagram of a hydraulic articulation system according to one embodiment of the disclosure.

FIG. 3 illustrates a hydraulic control circuit 200 for controlling operation of the articulation assembly 106. In particular, the hydraulic control circuit 200 is can control relative movement of the front and rear frames 18, 22 about the articulation joint 98 (FIG. 2). The hydraulic control circuit 200 can include a variety of valves, lines, connectors, and the like, all of which need not be described in detail herein. The hydraulic control circuit 200 may also be connected to, and optionally share one or more components with, other hydraulic control circuits (not shown) of the grader 10. For example, other hydraulic control circuits may be provided to control the steering assembly 82 and the blade positioning assembly 62. In addition, while the hydraulic control circuit 200 is described and illustrated herein in the context of the grader 10, the hydraulic control circuit 200 may be used in any other type of articulated work vehicle. Alternatively, the hydraulic control circuit 200 may be used to control other hydraulic assemblies including, for example, the steering assembly 82 or steering assemblies of other work vehicles.

The hydraulic control circuit 200 includes a pump 204 that may be driven by the prime mover 30, or alternatively by a secondary engine or electric motor. The pump 204 has an inlet 208 in fluid communication with a tank or reservoir 212 that contains a fluid (e.g., an oil-based hydraulic fluid). In the illustrated embodiment, the pump 204 is a variable displacement pump with a load sensing control 214 that receives feedback from a load sensing line 216. However, other types of pumps may be used. The control circuit 200 also includes a first valve assembly 310, a second valve assembly 410 and a third valve assembly 510. The three valve assemblies 310, 410, 510 are positioned fluidly between the pump 204 and the articulation actuators 114, 116.

The first valve assembly 310 includes a manual valve 312 which, in the illustrated embodiment, is an infinitely-variable spool valve. The manual valve 312 has an actuator 314 that is mechanically coupled to a user-manipulable control 126 located in the operator cab 26 of the grader 10 (FIG. 1). The user-manipulable control 126 may include one or more levers, foot pedals, a steering wheel, or any other such control. In other embodiments, the manual valve 312 may be replaced by an electrohydraulic valve, which may be coupled to the user-manipulable control 126 via a controller.

The illustrated manual valve 312 includes four ports: a pressure port 316, a tank port 318, a first work port 320, and a second work port 322 (FIG. 3). The pressure port 316 is in fluid communication with the pump 204, and the tank port 318 is in fluid communication with the reservoir 212. A first line 324 is connected to the first work port, and a second line 326 is connected to the second work port 322. The first and second lines 324, 326 are coupled to first and second work lines 328, 330 of the first valve assembly 310 via respective compensators 332. Each compensator 332 includes a two-position, two port valve 334, with a pilot 336 in fluid communication with the load sense line 216, and a pair of check valves 338*a*, 338*b*.

The spool of the manual valve 312 is movable between a first position, a second position, and a neutral position between the first and second positions. In the first position (i.e. the top position illustrated in FIG. 3), the manual 312 valve fluidly communicates the pressure port 316 with the first work port 320 and the tank port 318 with the second work port 322. This directs pressurized fluid from the pump 204 into the first line 324 (and first work line 328), and connects the second line 326 (and second work line 330) with the reservoir 212. In the second position (i.e. the bottom position illustrated in FIG. 3), the manual valve 312 fluidly communicates the pressure port 316 with the second work port 322 and the tank port 318 with the first work port 320. This directs pressurized fluid from the pump 204 into the second line 326 (and second work line 330), and connects the first line 324 (and first work line 328) with the reservoir 212. In the neutral position (i.e. the middle position illustrated in FIG. 3), which is a floating position in the illustrated embodiment, the valve 312 fluidly communicates the tank port 318 with both work ports 320, 322.

With continued reference to FIG. 3, the second valve assembly 410 includes an electrohydraulic valve 412 which, in the illustrated embodiment, is an infinitely-variable spool valve. The electrohydraulic valve 412 includes electronic actuators (e.g., solenoids) 414 in communication with a controller 220. The controller 220 may also be communicatively coupled to a variety of other modules or components of the grader 10. The controller 220 preferably includes combinations of hardware (e.g., a programmable microprocessor, non-transitory, machine-readable memory, and an input/output interface) and software that are programmed, configured, and/or operable to, among other things, control the operation of the electrohydraulic valve 412. The electronic actuators 414 are operable to translate a control signal from the controller 220 into movement of the spool.

The illustrated electrohydraulic valve 412 includes four ports: a pressure port 416, a tank port 418, a first work port 420, and a second work port 422. The pressure port 416 is in fluid communication the pump 204, and the tank port 418 is in fluid communication with the reservoir 212. In the illustrated embodiment, the pressure ports 316, 416 and the tank ports 318, 418 are respectively connected to the pump 204 and the tank 212 in parallel. A first line 424 of the second valve assembly 410 is connected to the first work port 420, and a second line 426 is connected to the second work port 422. The first and second lines 424, 426 are coupled to first and second work lines 428, 430 of the second valve assembly via respective compensators 432. Each compensator 432 includes a two position, two port valve 434, with a pilot 436 in fluid communication with the load sense line 216, and a pair of check valves 438*a*, 438*b*.

The spool of the electrohydraulic valve 412 is movable between a first position, a second position, and a neutral position between the first and second positions. In the first position (i.e. the bottom position illustrated in FIG. 3), the electrohydraulic valve 412 fluidly communicates the pressure port 416 with the first work port 420 and the tank port 418 with the second work port 422. This directs pressurized fluid from the pump 204 into the first line 424 and connects the second line 426 with the reservoir 212. In the second position (i.e. the top position illustrated in FIG. 3), the electrohydraulic valve 412 fluidly communicates the pressure port 416 with the second work port 422 and the tank port 418 with the first work port 420. This directs pressurized fluid from the pump 204 into the second line 426 and connects the first line 424 with the reservoir 212. In the neutral position (i.e. the middle position illustrated in FIG. 3), which is a floating position in the illustrated embodiment, the electrohydraulic valve 412 fluidly communicates the tank port 418 with both work ports 420, 422.

With continued reference to FIG. 3, the third valve assembly 510 is positioned fluidly between the first and second valve assemblies 310, 410 and the articulation actuators 114, 116. Thus, the third valve assembly 510 is positioned downstream of the first and second valve assemblies 310, 410 in the positive flow direction. The third valve assembly 510 includes a first directional valve 512 and a second directional valve 514. The work lines 328, 330 of the first valve assembly 310 and the work lines 428, 430 of the second valve assembly 410 are fluidly coupled to the third valve assembly 510 in parallel.

In the illustrated embodiment, each of the directional valves 512, 514 is a two position valve with three ports. The first directional valve 512 has a first port 516 in fluid communication with the first work line 328 of the first valve assembly 310 and a second port 518 in fluid communication with the first work line 428 of the second valve assembly 410. A third port 520 is in fluid communication with a first actuator line 522. The first directional valve 512 includes a spool movable between a first position (i.e. the top position illustrated in FIG. 3) and a second position (i.e. the bottom position illustrated in FIG. 3). In the first position, the first directional valve 512 fluidly communicates the first port 516 with the third port 520 (and thus the first work line 328 of the first valve assembly 310 with the first actuator line 522). In the second position, the first directional valve 512 fluidly communicates the second port 518 with the third port 520 (and thus the first work line 428 of the second valve assembly 410 with the first actuator line 522). The spool of the first directional valve 512 is biased toward the first position by a spring. The first actuator line 522 is in fluid communication with a head chamber 114*a* of the first articulation actuator 114 and a rod chamber 116*b* of the second articulation actuator 116.

Similarly, the second directional valve 514 has a first port 524 in fluid communication with the second work line 330 of the first valve assembly 310 and a second port 526 in fluid communication with the second work line 430 of the second valve assembly 410. A third port 528 is in fluid communication with a second actuator line 530. The second directional valve 514 includes a spool movable between a first position (i.e. the bottom position illustrated in FIG. 3) and a second position (i.e. the top position illustrated in FIG. 3). In the first position, the second directional valve 514 fluidly communicates the first port 524 with the third port 528 (and thus the second work line 330 of the first valve assembly 310 with the second actuator line 530). In the second position, the second directional valve 514 fluidly communicates the second port 526 with the third port 528 (and thus the second work line 430 of the second valve assembly 410 with the second actuator line 530). The spool of the second directional valve 514 is biased toward the first position by a spring. The second actuator line 530 is in fluid communication with a rod chamber 114*b* of the first articulation actuator 114 and a head chamber 116*a* of the second articulation actuator 116.

The third valve assembly 510 is configurable in a first state when the spools of the first and second directional valves 512, 514 are in their first positions. Accordingly, in the first state, the third valve assembly 510 fluidly communicates the work lines 328, 330 or outputs of the first valve assembly 310 with the articulation actuators 114, 116 such that the first valve assembly 310 controls operation of the actuators 114, 116. The third valve assembly 510 is configurable in a second state when the spools of the first and second directional valves 512, 514 are in their second positions. Accordingly, in the second state, the third valve assembly 510 fluidly communicates the work lines 428, 430 or outputs of the second valve assembly 410 with the articulation actuators 114, 116 such that the second valve assembly 410 controls operation of the actuators 114, 116.

Each of the directional valves 512, 514 includes a pilot 532 coupled to a pilot line 534 that extends between the work lines 428, 430 of the second valve assembly 410. As such, the directional valves 512, 514 are movable from the first position to the second position in response to elevated pressure in the pilot line 534. First and second pilot check valves 536, 538 are provided in the pilot line 534. The first pilot check valve 536 is configured to open in response to elevated pressure in the work line 428, and the second pilot check valve 538 is configured to open in response to elevated pressure in the work line 430. The first pilot check valve 536 has a pilot line 540 in fluid communication with the first work line 328 of the first valve assembly 310, and the second pilot check valve 538 has a pilot line 542 in fluid communication with the second work line 330 of the first valve assembly 310. The first and second pilot check valves 536, 538 are thus also configured to open in response to elevated pressure in the respective work lines 328, 330.

In the illustrated embodiment, the third valve assembly 510 further includes a third pilot check valve 544 provided in the first actuator line 522 and a fourth pilot check 546 valve provided in the second actuator line 530. The third pilot check valve 544 has a pilot line 548 in fluid communication with the second actuator line 530 upstream of the fourth pilot check valve 546 (with reference to the positive flow direction), and the fourth pilot check valve 546 has a pilot line 550 in fluid communication with the first actuator line 522 upstream of the third pilot check valve 544 (with reference to the positive flow direction).

In the illustrated embodiment, the second and third valve assemblies 410, 510 collectively define a valve section 600 that may be housed together as a single unit. As such, the valve section 600 may be readily incorporated into work vehicles with existing manual control circuits. Automatic operating functionality may thus be readily added to such work vehicles without replacing or significantly modifying an existing manual control circuit.

The grader 10 may be operated by a user positioned in the operator cab 26. The illustrated hydraulic control circuit 200 permits the user to control the articulation assembly 106 in either a manual operating mode or an automatic operating mode.

In the manual operating mode, the user may control the articulation assembly 106 via the user-manipulable control 126. For example, the user may articulate the frames 18, 22 to the left or to the right (relative to a forward direction of travel) by moving the control 126, which may facilitate turning the grader 10 to the left or to the right, respectively. The control 126 may also be coupled to the steering assembly 82 such that moving the control 126 also turns the front wheels 38 left or right. In such embodiments, the steering assembly 82 and the articulation assembly 106 may be calibrated to provide a desired turning response.

When the user moves the control 126 to articulate the frames 18, 22 to the right (i.e. to decrease an included angle between the front axis 90 and the rear axis 94 on the right side of the articulation axis 102), the actuator 314 translates movement of the user-manipulable control 126 into movement of the spool of the manual valve 312. The spool moves from the neutral position toward the first position, directing pressurized fluid from the pump 204 into the first work line 328 (via the associated compensator 332) and allowing fluid to drain from the second work line 330 into the reservoir 212. During manual operation, the third valve assembly 510 is in its first state, with the spools of the directional valves 512, 514 in their first positions. As such, the third valve assembly 510 fluidly communicates the work lines 328, 330 of the first valve assembly 310 with the actuator lines 522, 530.

The pressurized fluid from the first work line 328 flows into the first actuator line 522 and opens the third pilot check valve 544 when the pressure on the upstream side of the third pilot check valve 544 exceeds the valve's cracking pressure. The pressurized fluid then flows into the head chamber 114*a* of the first articulation actuator 114 and into the rod chamber 116*b* of the second articulation actuator 116. The pressurized fluid from the first work line 328 also opens the fourth pilot check valve 546 via the pilot line 550. This allows fluid to flow out of the rod chamber 114*b* of the first articulation actuator 114 and the head chamber 116*a* of the second articulation actuator 116, into the work line 330, and ultimately back to the reservoir 212. Thus, a pressure imbalance is created in each of the articulation actuators 114, 116. The rod 118 of the first articulation actuator 114 extends, and the rod 118 of the second articulation actuator 116 retracts, thereby articulating the frames 18, 22 to the right.

When the user moves the control 126 to articulate the frames 18, 22 to the left (i.e. to decrease an included angle between the front axis 90 and the rear axis 94 on the left side of the articulation axis 102), the actuator 314 translates movement of the user-manipulable control 126 into movement of the spool of the manual valve 312. The spool moves from the neutral position toward the second position, directing pressurized fluid from the pump 204 into the second work line 330 (via the associated compensator 332) and allowing fluid to drain from the first work line 328 into the reservoir 212. The third valve assembly 510 remains in its first state, with the spools of the directional valves 512, 514 in their first positions. As such, the third valve assembly 510 fluidly communicates the work lines 328, 330 of the first valve assembly 310 with the actuator lines 522, 530.

The pressurized fluid from the second work line 330 flows into the second actuator line 530 and opens the fourth pilot check valve 546 when the pressure on the upstream side of the valve 546 exceeds the valve's cracking pressure. The pressurized fluid then flows into the head chamber 116*a* of the second articulation actuator 116 and into the rod chamber 114*b* of the second articulation actuator 114. The pressurized fluid from the second work line 330 also opens the third pilot check valve 544 via the pilot line 548. This allows fluid to flow out of the rod chamber 116*b* of the second articulation actuator 116 and the head chamber 114*a* of the first articulation actuator 114, into the work line 328, and ultimately back to the reservoir 212. Thus, a pressure imbalance is created in each of the articulation actuators 114, 116. The rod 118 of the second articulation actuator 116 extends, and the rod 118 of the first articulation actuator 114 retracts, thereby articulating the frames 18, 22 to the left.

After articulating the frames 18, 22 to the right or to the left to an articulated position, the user may desire to return the frames 18, 22 to a non-articulated (i.e. straight) position in which the front axis 90 and the rear axis 94 are substantially aligned. The user may move the control 126 to return the frames 18, 22 to the non-articulated position; however, it may be difficult arrive precisely at the non-articulated position using the control 126 in the manual operating mode. Accordingly, the illustrated control system 200 also allows the user to return the frames 18, 22 to a selected position (e.g., the non-articulated position or any other position selected by the user) automatically.

In the automatic operating mode, the user may control the articulation assembly 106 via the controller 220. First, the user selects a target position. The user may select the target position by pressing a virtual or hardware button on the controller 220 corresponding with the target position, entering the target position into the controller 220 (e.g., via a keyboard), choosing the target position from a table, etc. Once the target position is selected, the user commands the controller 220 to pivot the frames 118, 122 to the selected position. The controller 220 automatically operates the second valve assembly 410 to direct pressurized fluid from the pump 204 to the articulation actuators 114, 116 in order to pivot the frames 118, 122 to the selected position. The automatic operating mode may be particularly advantageous when the user desires to return the frames 18, 22 to the non-articulated position. However, it should be understood that references in the following description to the non-articulated position could be replaced with any other position selected by the user via the controller 220.

When the frames 18, 22 are articulated to the left and the user commands the controller 220 to return the frames 18, 22 to the non-articulated position, the controller 220 sends an electronic control signal to the electronic actuators 414 of the electrohydraulic valve 412 (e.g., by varying a voltage and/or current supplied to the actuators 414). The actuators 414 move the spool from the neutral position toward the first position. This directs pressurized fluid from the pump 204 into the first work line 428 (via the associated compensator 432). The second work line 430 is fluidly communicated with the reservoir 212, allowing fluid to drain from the second work line 430 into the reservoir 212.

As pressure builds in the first work line 428, the pressure acts against the first pilot check valve 536. When the pressure exceeds the cracking pressure of the valve 536, the first work line 428 pressurizes the pilot line 534 downstream of the first pilot check valve 536. The pressurized fluid is supplied to the pilots 532, which shift the first and second directional valves 512, 514 to their second positions. In other words, the third valve assembly 510 is actuated to its second state, in which the third valve assembly 510 fluidly communicates the work lines 428, 430 of the second valve assembly 410 with the actuator lines 522, 530, in response to increased fluid pressure (i.e. a pressure signal) in one of the work lines 428, 430 of the second valve assembly 410.

The pressurized fluid from the first work line 428 flows into the first actuator line 522 and opens the third pilot check valve 544 when the pressure on the upstream side of the third pilot check valve 544 exceeds the valve's cracking pressure. The pressurized fluid then flows into the head chamber 114*a* of the first articulation actuator 114 and into the rod chamber 116*b* of the second articulation actuator 116. The pressurized fluid from the first work line 428 also opens the fourth pilot check valve 546 via the pilot line 550. This allows fluid to flow out of the rod chamber 114*b* of the first articulation actuator 114 and the head chamber 116*a* of the second articulation actuator 116, into the work line 430, and ultimately back to the reservoir 212. Thus, a pressure imbalance is created in each of the articulation actuators 114, 116. The rod 118 of the first articulation actuator 114 extends, and the rod 118 of the second articulation actuator 116 retracts, thereby articulating the frames 18, 22 to the right until they reach the non-articulated position. The controller 220 may receive feedback from one or more sensors (not shown) that indicate when the frames 18, 22 reach the non-articulated position.

When the frames 18, 22 are articulated to the right and the user commands the controller 220 to return the frames 18, 22 to the non-articulated position, the controller 220 sends an electronic control signal the electronic actuators 414 of the electrohydraulic valve 412 (e.g., by varying a voltage and/or current supplied to the actuators 414). The actuators 414 move the spool from the neutral position toward the second position. Pressurized fluid from the pump 204 is directed into the second work line 430 (via the associated compensator 432). The first work line 428 is fluidly communicated with the reservoir 212, allowing fluid to drain from the first work line 428 into the reservoir 212.

As pressure builds in the second work line 430, the pressure acts against the second pilot check valve 538. When the pressure exceeds the cracking pressure of the valve 538, the second work line 430 pressurizes the pilot line 534 downstream of the second pilot check valve 538. The pressurized fluid is supplied to the pilots 532, which shift the first and second directional valves 512, 514 to their second positions such that the third valve assembly 510 fluidly communicates the work lines 428, 430 of the second valve assembly 410 with the actuator lines 522, 530.

The pressurized fluid from the second work line 430 flows into the second actuator line 530 and opens the fourth pilot check valve 546 when the pressure on the upstream side of the fourth pilot check valve 546 exceeds the valve's cracking pressure. The pressurized fluid then flows into the head chamber 116*a* of the second articulation actuator 116 and into the rod chamber 114*b* of the first articulation actuator 114. The pressurized fluid from the second work line 430 also opens the third pilot check valve 544 via the pilot line 548. This allows fluid to flow out of the rod chamber 116*b* of the second articulation actuator 116 and the head chamber 114*a* of the first articulation actuator 114, into the first work line 428, and ultimately back to the reservoir 212. Thus, a pressure imbalance is created in each of the articulation actuators 114, 116. The rod 118 of the second articulation actuator 116 extends, and the rod 118 of the first articulation actuator 114 retracts, thereby articulating the frames 18, 22 to the left until they reach the non-articulated position.

In the illustrated embodiment, the control circuit 200 allows the user to override movement of the articulation actuators 114, 116 during the automatic operating mode by moving the user-manipulable control 126. This advantageously allows the user to quickly regain manual control of the articulation assembly 106 (e.g., to steer around an obstacle).

When the user moves the user-manipulable control 126 when the control circuit 200 is operating in the automatic mode, the spool of the manual valve 312 moves toward either the first or second position, which supplies pressurized hydraulic fluid from the pump 204 to either the first work line 328 or the second work line 330. The first pilot check valve 536 is in fluid communication with the first work line 328 via the pilot line 540 such that elevated pressure in the first work line 328 opens the first pilot check valve 536. Likewise, the second pilot check valve 538 is in fluid communication with the second work line 330 via the pilot line 542 such that elevated pressure in the second work line 330 opens the second pilot check valve 538. This dumps fluid out of the pilot line 534. The directional valves 512, 514 then return to their first positions (under the influence of springs), fluidly communicating the first valve assembly 310 with the articulation actuators 114, 116 and isolating the second valve assembly 410 from the articulation actuators 114, 116. Thus, the third valve assembly 510 is actuatable from the second state to the first state in response to movement of the user-manipulable control 126 such that the first valve assembly 310 regains control over the articulation actuators 114, 116.

Various features of the disclosure are set forth in the following claims.

What is claimed is:

1. A work vehicle comprising:

a first frame;

a second frame pivotally coupled to the first frame at an articulation joint; and a control circuit operable to control relative movement of the first and second frames about the articulation joint, the control circuit including a pump, an actuator in fluid communication with the pump, a first valve assembly coupled to a user-manipulable control, and a second valve assembly, wherein the control circuit is operable in a manual operating mode in which the first valve assembly is configured to direct fluid from the pump to the actuator in response to movement of the user-manipulable control to pivot the first and second frames, and wherein the control circuit is operable in an automatic operating mode in which the second valve assembly is configured to direct fluid from the pump to the actuator in response to receiving an electronic control signal to automatically pivot the first and second frames to a selected position.

2. The work vehicle of claim 1, further comprising a third valve assembly positioned fluidly between the first and second valve assemblies and the actuator, the third valve assembly configurable in a first state in which the third valve assembly fluidly communicates the first valve assembly with the actuator and configurable in a second state in which the third valve assembly fluidly communicates the second valve assembly with the actuator.

3. The work vehicle of claim 2, wherein the third valve assembly is actuatable from the second state to the first state in response to movement of the user-manipulable control.

4. The work vehicle of claim 2, wherein the third valve assembly is actuatable from the first state to the second state in response to a pressure signal from an output of the second valve assembly.

5. The work vehicle of claim 2, wherein the third valve assembly is biased toward the first state.

6. The work vehicle of claim 1, wherein the first valve assembly includes a manual valve mechanically coupled to the user-manipulable control.

7. The work vehicle of claim 1, wherein the second valve assembly includes an electrohydraulic valve.

8. The work vehicle of claim 1, further comprising a work implement supported by the first frame and a prime mover supported by the second frame.

9. A work vehicle comprising:

a first frame;

a second frame pivotally coupled to the first frame at an articulation joint; and a control circuit operable to control relative movement of the first and second frames about the articulation joint, the control circuit including a pump, an actuator operable to pivot the first and second frames about the articulation joint in response to receiving fluid from the pump, a first valve assembly configured to direct fluid from the pump to the actuator, a second valve assembly configured to direct fluid from the pump to the actuator, and a third valve assembly positioned fluidly between the first and second valve assemblies and the actuator, the third valve assembly configurable in a first state in which the third valve assembly fluidly communicates the first valve assembly with the actuator such that the first valve assembly controls movement of the actuator, and configurable in a second state in which the third valve assembly fluidly communicates the second valve assembly with the actuator such that the second valve assembly controls movement of the actuator wherein the second valve assembly is configured to direct fluid from the pump to the actuator to automatically pivot the first and second frames to a selected orientation.

10. The work vehicle of claim 9, wherein the first valve assembly includes a manual valve, and wherein the second valve assembly includes an electrohydraulic valve.

11. The work vehicle of claim 10, wherein the manual valve is mechanically coupled to a user-manipulable control.

12. The work vehicle of claim 10, wherein the third valve assembly is biased toward the first state.

13. The work vehicle of claim 12, wherein the third valve assembly is actuatable from the first state to the second state in response to a pressure signal from an output of the second valve assembly.

14. The work vehicle of claim 9, wherein the first valve assembly is operable to override the second valve assembly.

15. A method of operating a work vehicle having first and second frame members pivotally coupled at an articulation joint and an actuator operable to pivot the first and second frames about the articulation joint in response to receiving fluid from a pump, the method comprising:

moving a user-manipulable control to direct fluid from the pump to the actuator via a first valve assembly to pivot the first and second frame members from a non-articulated position to an articulated position;

commanding a controller to return the first and second frame members to the non-articulated position; and directing fluid from the pump to the actuator via a second valve assembly to automatically pivot the first and second frame members to the non-articulated position.

16. The method of claim 15, wherein directing fluid from the pump to the actuator via the second valve assembly includes actuating a third valve assembly from first state in which the third valve assembly fluidly communicates the first valve assembly with the actuator to a second state in which the third valve assembly fluidly communicates the second valve assembly with the actuator.

17. The method of claim 16, wherein the third valve assembly is biased toward the first state.

18. The method of claim 16, wherein a pressure signal output by the second valve assembly actuates the third valve assembly from the first state to the second state.

19. The method of claim 15, wherein the first valve assembly includes a manual valve mechanically coupled to the user-manipulable control, and wherein the second valve assembly includes an electrohydraulic valve in communication with the controller.

* * * * *